US008795007B2

(12) United States Patent
Itou et al.

(10) Patent No.: US 8,795,007 B2
(45) Date of Patent: Aug. 5, 2014

(54) TERMINAL FITTING

(71) Applicant: Sumitomo Wiring Systems, Ltd., Yokkaichi (JP)

(72) Inventors: Tomoya Itou, Yokkaichi (JP); Shinji Iihoshi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 68 days.

(21) Appl. No.: 13/629,987

(22) Filed: Sep. 28, 2012

(65) Prior Publication Data

US 2013/0078874 A1 Mar. 28, 2013

(30) Foreign Application Priority Data

Sep. 28, 2011 (JP) ..... 2011-212626
Oct. 12, 2011 (JP) ..... 2011-224890

(51) Int. Cl.
*H01R 11/22* (2006.01)

(52) U.S. Cl.
USPC ..... 439/852

(58) Field of Classification Search
USPC ..... 439/843–847, 852
See application file for complete search history.

(56) References Cited

U.S. PATENT DOCUMENTS 4,447,110 A * 5/1984 Punako et al. ..... 439/843
4,540,234 A * 9/1985 Konnemann et al. ..... 439/839
4,540,235 A * 9/1985 Lolic ..... 439/839
4,583,812 A * 4/1986 Gross et al. ..... 439/839
4,932,877 A * 6/1990 Zinn ..... 439/839
5,007,865 A * 4/1991 Jakobeit ..... 439/839
5,035,661 A * 7/1991 Steinhardt et al. ..... 439/839
5,094,636 A * 3/1992 Zinn et al. ..... 439/839
5,108,318 A * 4/1992 Sakurai et al. ..... 439/744
5,188,545 A * 2/1993 Hass et al. ..... 439/851
5,240,439 A * 8/1993 Egenolf ..... 439/745
5,246,390 A * 9/1993 Egenolf ..... 439/839
5,295,873 A * 3/1994 Walbrecht ..... 439/839
5,322,459 A * 6/1994 Spinnato ..... 439/843
5,334,058 A * 8/1994 Hotea ..... 439/839
5,338,229 A * 8/1994 Egenolf ..... 439/839
5,362,262 A * 11/1994 Hotea ..... 439/839
5,419,723 A * 5/1995 Villiers et al. ..... 439/843
5,437,566 A * 8/1995 Zinn et al. ..... 439/839
5,516,310 A * 5/1996 Sawada ..... 439/843
5,599,212 A * 2/1997 Sawada ..... 439/843
5,607,328 A * 3/1997 Joly ..... 439/852
5,634,825 A * 6/1997 Maki ..... 439/745
5,664,972 A * 9/1997 Zinn et al. ..... 439/839
5,685,746 A * 11/1997 Maejima ..... 439/845
5,695,368 A * 12/1997 Joly et al. ..... 439/748

(Continued)

*Primary Examiner* — Ross Gushi
(74) *Attorney, Agent, or Firm* — Gerald E. Hespos; Michael J. Porco; Matthew T. Hespos

(57) ABSTRACT

A terminal fitting (10) includes a terminal main body (11) and a shell (12), which is a component separate from the terminal main body (11). The terminal main body (11) has a fitting portion (18) and resilient contact pieces (14). The shell (12) is a rectangular tube engaged with the fitting portion (18) of the terminal main body (11) and surrounding the resilient contact pieces (14). Even though being relatively expensive, an electrically conductive material such as copper alloy needs to be used as the material of the terminal main body (11) formed with the resilient contact pieces (14). However, an inexpensive material can be used for the shell (12) since electrical conductivity is not required. Therefore, cost can be reduced as compared with the case where a terminal fitting is made entirely of an expensive electrically conductive material.

7 Claims, 10 Drawing Sheets

(56) References Cited

U.S. PATENT DOCUMENTS

| | | | | | |
|---|---|---|---|---|---|
| 5,863,225 | A * | 1/1999 | Liebich et al. | 439/845 |
| 5,868,590 | A * | 2/1999 | Dobbelaere | 439/839 |
| 5,897,404 | A * | 4/1999 | Goodman et al. | 439/843 |
| 5,938,485 | A * | 8/1999 | Hotea et al. | 439/839 |
| 5,947,777 | A | 9/1999 | Chaillot et al. | |
| 5,951,336 | A * | 9/1999 | Seko et al. | 439/745 |
| 5,951,338 | A * | 9/1999 | Seko et al. | 439/843 |
| 5,954,548 | A * | 9/1999 | Stabroth | 439/839 |
| 5,975,964 | A * | 11/1999 | Seko et al. | 439/857 |
| 6,019,646 | A * | 2/2000 | Okamura et al. | 439/852 |
| 6,102,752 | A * | 8/2000 | Bommel et al. | 439/845 |
| 6,152,787 | A * | 11/2000 | Serbin et al. | 439/852 |
| 6,186,840 | B1 * | 2/2001 | Geltsch et al. | 439/843 |
| 6,361,377 | B1 * | 3/2002 | Saka et al. | 439/745 |
| 6,394,858 | B1 * | 5/2002 | Geltsch et al. | 439/852 |
| 6,402,571 | B1 * | 6/2002 | Muller et al. | 439/745 |
| 6,439,935 | B2 * | 8/2002 | Saka et al. | 439/852 |
| 6,475,039 | B1 * | 11/2002 | Despouys | 439/843 |
| 6,565,396 | B2 * | 5/2003 | Saka et al. | 439/843 |
| 6,679,736 | B2 * | 1/2004 | Saka | 439/748 |
| 6,872,103 | B1 * | 3/2005 | Flieger et al. | 439/839 |
| 7,014,515 | B2 * | 3/2006 | Lutsch et al. | 439/843 |
| 7,094,114 | B2 * | 8/2006 | Kurimoto | 439/839 |
| 7,241,175 | B2 * | 7/2007 | Johannes et al. | 439/620.05 |
| 7,278,891 | B2 * | 10/2007 | Cvasa et al. | 439/852 |
| 7,300,319 | B2 * | 11/2007 | Lutsch et al. | 439/852 |
| 7,556,542 | B2 * | 7/2009 | Lischeck et al. | 439/851 |
| 7,717,759 | B2 * | 5/2010 | Ishigami | 439/851 |
| 7,731,550 | B2 * | 6/2010 | Falchetti | 439/857 |
| 7,988,505 | B2 * | 8/2011 | Hotea et al. | 439/852 |
| 8,303,352 | B2 * | 11/2012 | Hangartner et al. | 439/852 |
| 8,616,925 | B2 * | 12/2013 | Kobayashi et al. | 439/857 |
| 2001/0049237 | A1 * | 12/2001 | Saka et al. | 439/843 |
| 2001/0051471 | A1 * | 12/2001 | Saka et al. | 439/843 |
| 2002/0160666 | A1 * | 10/2002 | Sato et al. | 439/852 |
| 2004/0106333 | A1 * | 6/2004 | Zhao et al. | 439/843 |
| 2004/0116002 | A1 * | 6/2004 | Rozet et al. | 439/843 |
| 2005/0054247 | A1 * | 3/2005 | Lutsch et al. | 439/843 |
| 2006/0252294 | A1 * | 11/2006 | Cvasa et al. | 439/252 |
| 2011/0045712 | A1 * | 2/2011 | Mukuno | 439/845 |
| 2012/0309240 | A1 * | 12/2012 | Yang et al. | 439/843 |
| 2013/0052883 | A1 * | 2/2013 | Iihoshi | 439/748 |
| 2013/0078874 | A1 * | 3/2013 | Itou et al. | 439/852 |

* cited by examiner

TERMINAL FITTING

BACKGROUND OF THE INVENTION

1. Field of the Invention

The invention relates to a terminal fitting.

2. Description of the Related Art

U.S. Pat. No. 5,947,777 discloses a female terminal fitting with resilient contact piece accommodated in a rectangular tube. A tab of a mating male terminal is inserted into the rectangular tube and presses the resilient contact piece. As a result, the resilient contact piece is deformed and the tab is sandwiched resiliently between the resilient contact piece and a wall of the rectangular tube. The rectangular tube ensures a contact pressure between the tab and the resilient contact piece and also protects the resilient contact piece by surrounding it.

The above-described terminal fitting, including the rectangular tube and the resilient contact piece, is formed from a single piece of an electrically conductive copper alloy. The copper alloy, however, is relatively expensive and leads to a high production cost for the terminal fitting.

The invention was completed in view of the above situation and an object thereof is to enable a cost reduction.

SUMMARY OF THE INVENTION

The invention relates to a terminal fitting that has a terminal main body and a shell. The terminal main body has a fitting portion and at least one resilient contact piece. The shell is a component separate from the terminal main body, but is assembled with the terminal main body by engaging the fitting portion. The shell is substantially in the form of a tube surrounding the resilient contact piece.

An electrically conductive material, such as copper alloy, needs to be used as the material of the terminal main body formed with the at least one resilient contact piece, despite the relatively high cost. However, an inexpensive material can be used for the shell because electrical conductivity is not required or secondary. Therefore, cost can be reduced as compared with the case where a terminal fitting is made entirely of an expensive electrically conductive material.

The fitting portion preferably corresponds to only one end part of the shell in a length direction. Thus, a dimension of the shell in the length direction can be short and the material cost of the terminal main body can be reduced as compared with the case where the fitting portion extends over the entire length of the shell.

The resilient contact piece preferably is cantilevered along the length direction of the shell from the fitting portion.

The terminal main body preferably includes a substantially plate-like portion cantilevered along the length direction of the shell from the fitting portion. The resilient contact piece may be formed by cutting a part of the plate-like portion and turning the cut part in the substantially same direction as an extending direction of the plate-like portion.

The above-described structure results in a shorter resilient contact piece along the length direction of the shell. Therefore, a resilient force of the resilient contact piece increases to increase a contact pressure.

Two resilient pieces preferably are formed on the terminal main body and extend from opposite side edges of the resilient contact piece in a width direction and contact an inner wall surface of the shell. The resilient pieces prevent inclination of the resilient contact piece even if an external force acts to incline the resilient contact piece.

At least one restricting portion preferably is formed on the shell and restricts an improper deformation of the resilient contact piece by contacting the extending end edges of the resilient pieces. The at least one restricting portion preferably comprises two restricting portions that are vertically symmetric and/or are bilaterally symmetric. The prevention of an improper deformation of the resilient contact piece by the contact of the resilient pieces with the restricting portion improves the reliability of a contact function by the resilient contact piece.

A front end part of the resilient contact piece is widened and is higher than an area behind it. The widened part preferably has two projections projecting vertically from both upper and lower edges of the resilient contact piece.

These and other objects, features and advantages of the invention will become more apparent upon reading the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
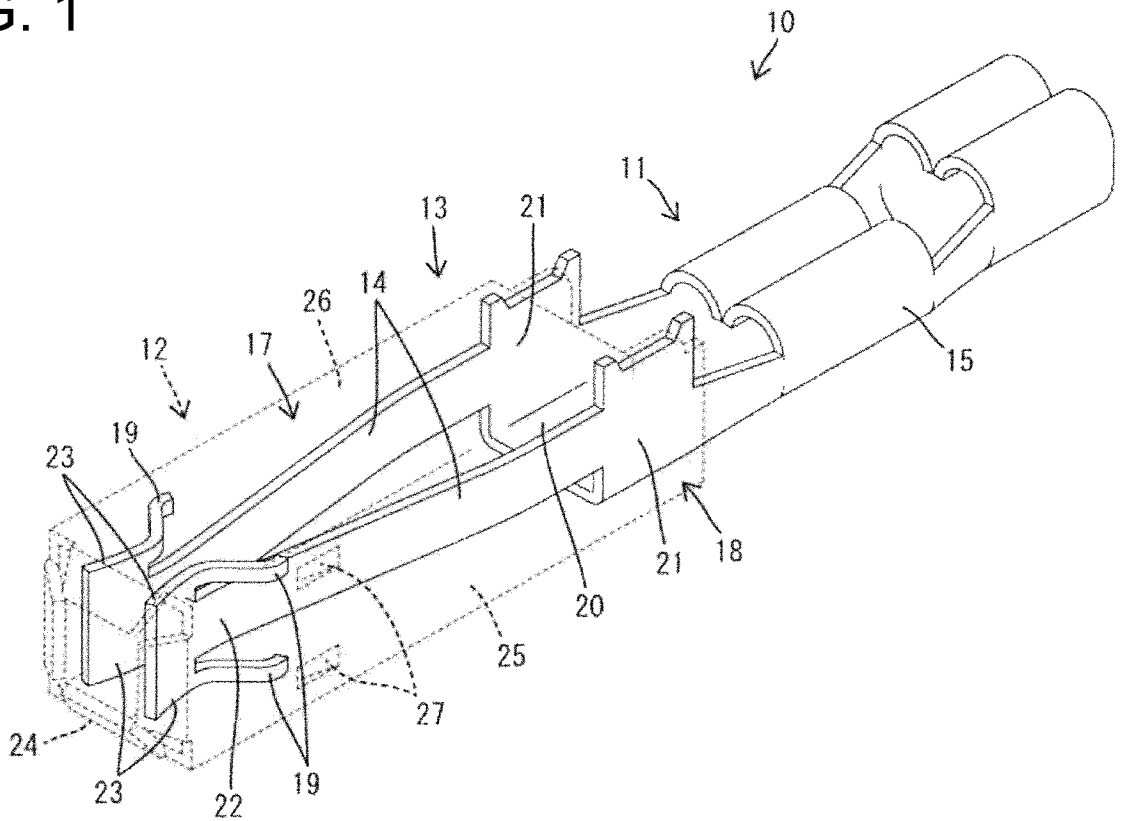
FIG. 1 is a perspective view of a terminal fitting according to a first embodiment.
Figure 2:
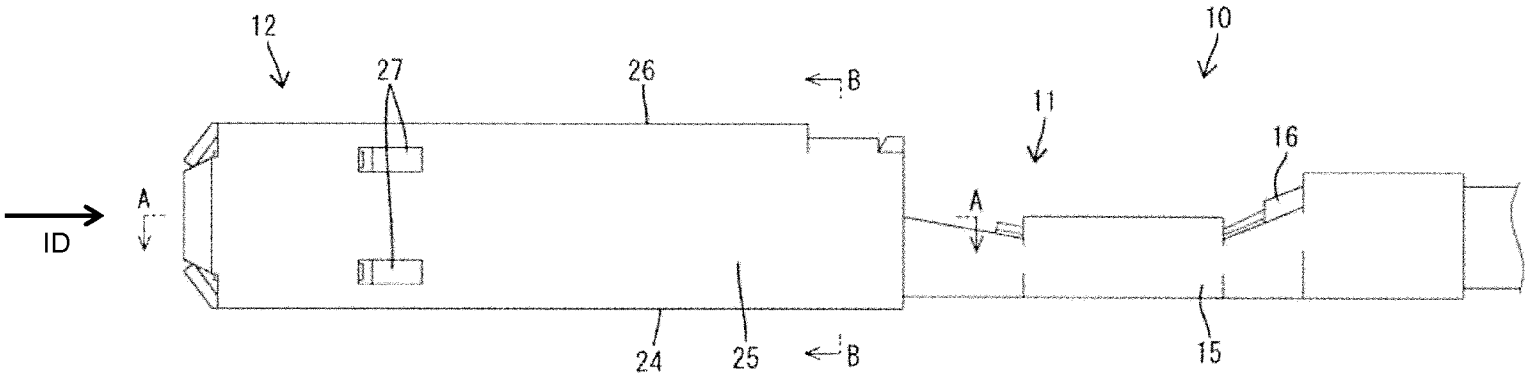
FIG. 2 is a side view of the terminal fitting.
Figure 3:
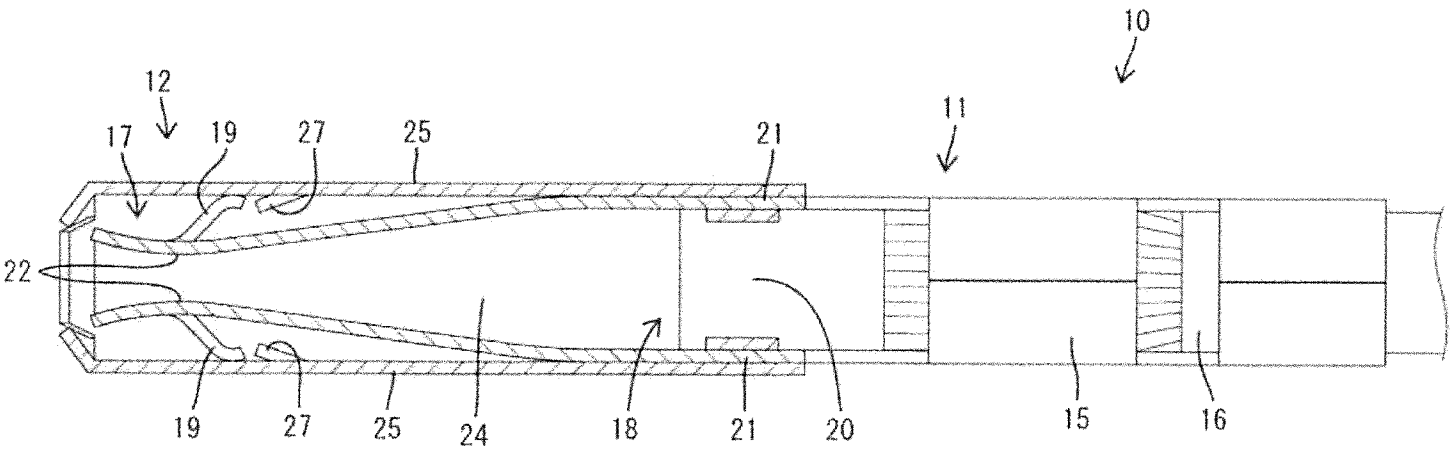
FIG. 3 is a section along A-A of FIG. 2.
Figure 4:
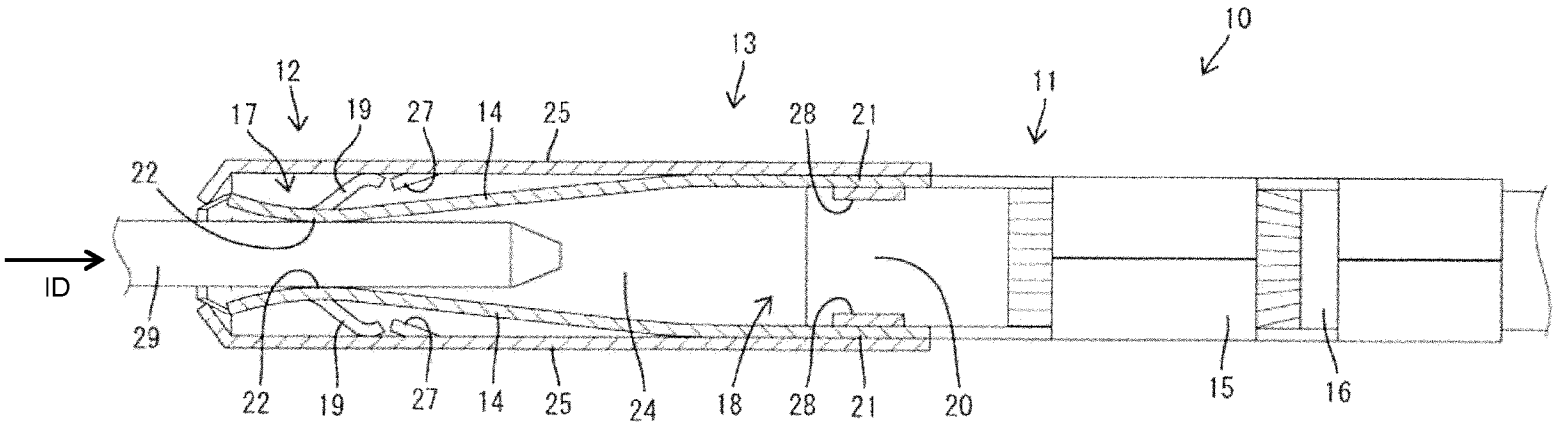
FIG. 4 is a section along A-A showing a state where a tab is inserted.

A first embodiment of the invention is described with reference to FIGS. 1 to 5. A terminal fitting 10 of the first embodiment is long and narrow in forward and backward directions and includes a terminal main body 11 and a shell 12 that are components separate from each other as shown in FIGS. 1 to 4. The terminal main body 11 is made of copper alloy, and the shell 12 is made of a material different from the terminal main body 11, such as stainless steel or an inexpensive material other than stainless steel. A rectangular tube 13 is formed at a front area of the terminal fitting 10 in forward and can receive a tab 29 of a male terminal inserted from the front along an insertion direction ID. As shown in FIGS. 1, 3 and 4, two resilient contact pieces 14 are accommodated in the rectangular tube 13 and can be brought resiliently into contact with the tab 29. A wire crimping portion 15 in the form of at least one open barrel is formed in a rear area of the terminal fitting 10 and can be crimped, bent or folded into connection with the wire 16.

The terminal main body 11 is formed by applying bending, folding and/or embossing to a conductive metal plate material punched out or cut into a specified shape. As shown in FIGS. 1, 3 and 4, a contact functioning portion 17 is formed at a front area of the terminal main body 11 and the wire crimping portion 15 is formed at a rear area of the terminal main body 11. The contact functioning portion 17 includes a substantially box-shaped fitting portion 18, two resilient contact pieces 14 and two pairs of resilient pieces 19. As shown in FIGS. 1, 3 to 5, the fitting portion 18 includes a lower wall 20 and two side walls 21 projecting at substantially right angles from left and right edges of the lower wall 20.

As shown in FIGS. 1, 3 and 4, the resilient contact pieces 14 are cantilevered substantially forward from the side walls 21 and hence extend in a direction substantially opposite to an inserting direction ID of the tab 29 into the rectangular tube 13. The resilient contact pieces 14 are substantially bilaterally symmetric and when viewed from above are curved to approach one another. Contact portions 22 are defined where the resilient contact pieces 14 are closest and contact the tab 29 inserted into the tube 13.

As shown in FIG. 1, projections 23 project from upper and lower edges of each resilient contact piece 14 at a front part of each resilient contact piece 14. The projections 23 have a larger height than an area behind the projections 23. A resilient piece 19 is cantilevered back from each projection 23. The resilient pieces 19 on each resilient contact piece 14 are substantially vertically symmetric. Further, the resilient pieces 19 on the right side and those on the left side substantially are bilaterally symmetric. The resilient pieces 19 are shorter in forward and backward directions than the resilient contact pieces 14. Further, the rear extending ends of the resilient pieces 19 are located behind the contact portion 22. The shapes of the resilient pieces 19 viewed from above are curved to approach the mating resilient pieces 19.

Figure 5:
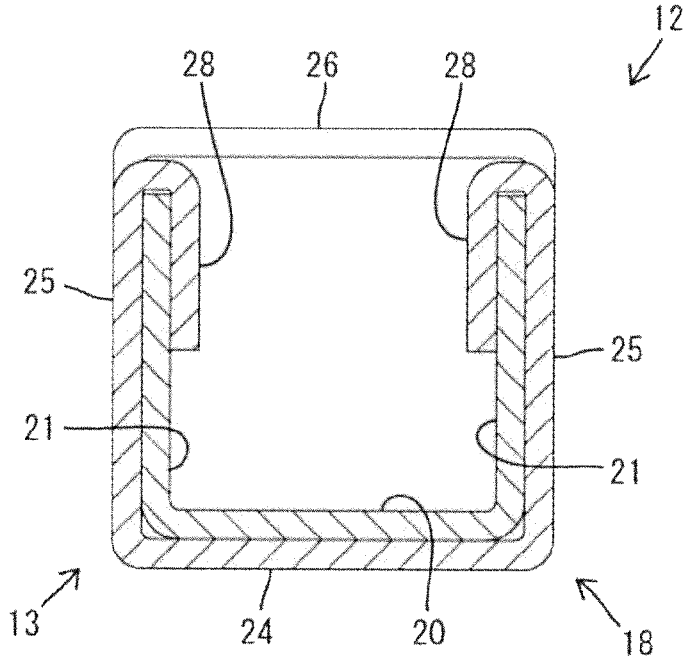
FIG. 5 is a section along B-B of FIG. 2.

As shown in FIG. 5, the shell 12 has a substantially tubular shape and includes a lower plate 24, left and right side plates 25 projecting at substantially right angles from the left and right sides of the lower plate 24 and an upper plate 26 extending at a substantially right angle from the upper end of one side plate 25. As shown in FIGS. 3 and 4, each of the left and right side plates 25 is cut to form two forwardly projecting restricting portions 27 that are bent to extend obliquely in on the shell 12. The two restricting portions 27 on each side plate portion 25 particularly are vertically symmetric. Further, the right restricting portions 27 and the left restricting portions 27 are bilaterally symmetric.

The shell 12 is assembled with the terminal main body 11 to surround the contact functioning portion 17 so that the fitting portion 18 is at a rear part of the shell 12 and the rectangular tube 13 is formed by the shell and the fitting portion 18. As shown in FIG. 5, the lower plate 24 and the lower wall 20 overlap in substantially surface contact with each other. As shown in FIGS. 3 and 4, the left and right side plates 25 and the left and right side walls 21 also overlap in substantially surface contact with each other. Further, as shown in FIGS. 3 to 5, holding pieces 28 are folded to extend substantially in and down inside the fitting portion 18 from the upper ends of the side plates 25 and are held in close contact with the inner surfaces of the left and right side walls 21 and laterally sandwich the side walls 21 between the holding pieces 28 and the side plates 25 to hold the shell 12 and the terminal main body 11 in an assembled state.

In the assembled state of the shell 12 and the terminal main body 11, the resilient contact pieces 14 face the inner surfaces of the left and right side plates 25 while being spaced therefrom and the rear extending ends of the resilient pieces 19 are held in contact with the inner surfaces of the left and right side plates 25, as shown in FIGS. 3 and 4. Further, the rear extending ends of the resilient pieces 19 substantially face the front extending ends of the restricting portions 27 from the front while being spaced apart.

The tab 29 is inserted into the rectangular tube 13 and deforms the resilient contact pieces 14 laterally away from each other. This outward deformation of the resilient contact pieces 14 causes the resilient pieces 19 to deform resiliently and deflect laterally with their extending ends held in contact with the side plates 25. Thus, the extending ends of the resilient contact pieces 19 displace back while sliding in contact with the side plates 25. As shown in FIG. 4, resilient deformation amounts and resilient restoring forces of the resilient contact pieces 14 and the resilient pieces 19 are maximized when the tab 29 is inserted completely.

Note that the resilient pieces 19 do not contact the restricting portions 27 when the tab 29 is inserted properly into the tube 13. The resilient deformation amount of the resilient contact pieces 14 increases beyond a proper range if the tab 29 is inserted in an improper posture and the resilient contact pieces 14 could deform to buckle. However, the extending ends of the resilient pieces 19 contact the front end of the restricting portions 27 while the resilient deformation amount of the resilient contact piece 14 falls within the range of resilient resiliency. Thus, any further improper resilient deformation of the resilient contact piece 14 is hindered. In this way, the resilient contact pieces 14 will not deform beyond their resiliency limit and buckle.

The terminal fitting 10 includes the terminal main body 11 formed with the fitting portion 18 and the resilient contact pieces 14. The terminal fitting 10 also includes the rectangular tubular shell 12 that is a component separate from the terminal main body 11. The shell is assembled with the terminal main body 11 by engaging the fitting portion 18 and surrounds the resilient contact pieces 14. An electrically conductive material, such as copper alloy, needs to be used as the material of the terminal main body 11 formed with the resilient contact pieces 14 despite the relative expense. On the other hand, the shell 12 is separate from the terminal main body 11 and electrical conductivity is not required. Thus, an inexpensive material can be used. Therefore, the cost of the terminal fitting 10 of this first embodiment can be reduced as compared with the case where a terminal fitting is made entirely of an expensive electrically conductive material.

The fitting portion 18 corresponds only to the rear part of the shell 12 in a length direction, and the resilient contact pieces 14 are cantilevered forward from the fitting portion 18. Accordingly, a dimension of the fitting portion 18 in the length direction of the shell 12 can be short, thereby reducing the material cost of the terminal main body 11 as compared with the case where a fitting portion extends over the entire length of a shell.

Two resilient pieces 19 extend from the opposite side edges of each resilient contact piece 14 in a width direction and resiliently contact the inner surface of the shell 12. The resilient contact of the resilient pieces 19 with the inner surface of the tube 13 ensures that external forces will not incline the resilient contact piece 14. Further, the shell 12 is formed with the restricting portions 27 that can contact extending end edges of the resilient pieces 19 for restricting improper deformations of the resilient contact pieces 14 and thereby improving the reliability of the contact function by the resilient contact pieces 14.

Figure 6:
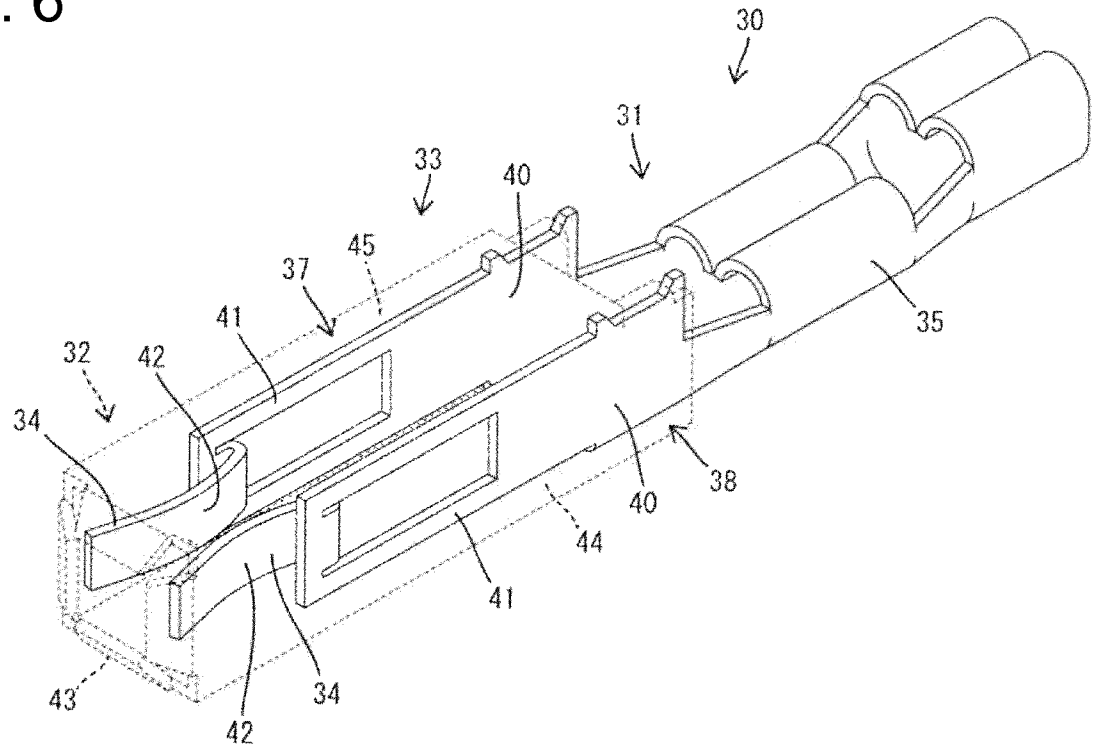
FIG. 6 is a perspective view of a terminal fitting according to a second embodiment.
Figure 8:
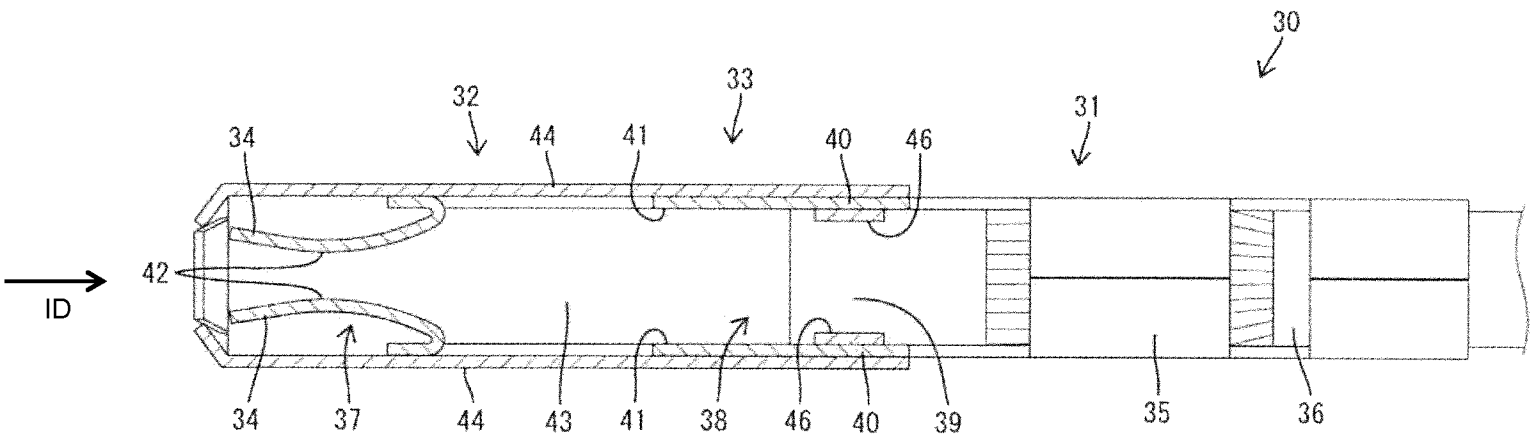
FIG. 8 is a section along C-C of FIG. 7.
Figure 9:
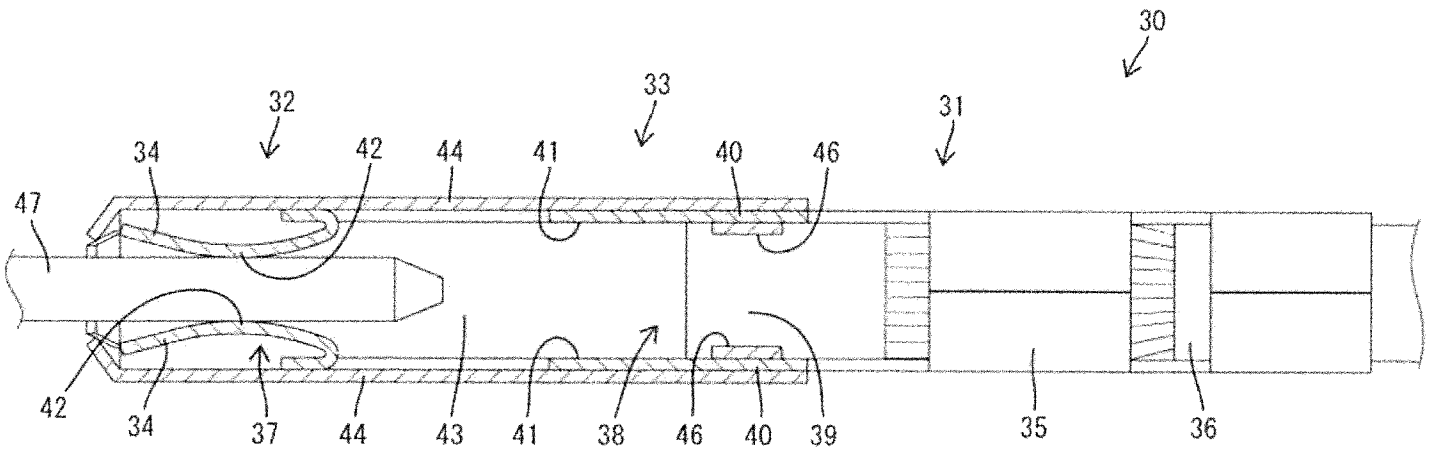
FIG. 9 is a section along C-C showing a state where a tab is inserted.

A second embodiment of the invention is described below with reference to FIGS. 6 to 10. A terminal fitting 30 of the second embodiment is long and narrow in forward and backward directions and includes a terminal main body 31 and a shell 32, which are components separate from each other as shown in FIGS. 6, 8 and 9. The terminal main body 31 is made of copper alloy, and the shell 32 is made of a material different from the terminal main body 31, such as stainless steel or an inexpensive material other than stainless steel. A rectangular tube 33 is formed at front area of the terminal fitting 30 and can receive a tab 47 of a male terminal inserted from the front and along an insertion direction ID. Resilient contact pieces 34 are accommodated in the rectangular tube 33 and can resiliently contact the tab 47. As shown in FIGS. 6 to 9, a wire crimping portion 35 in the form of at least one open barrel is formed in a rear area of the terminal fitting 30 and can be crimped, bent or folded into connection with a wire 36.

Figure 10:
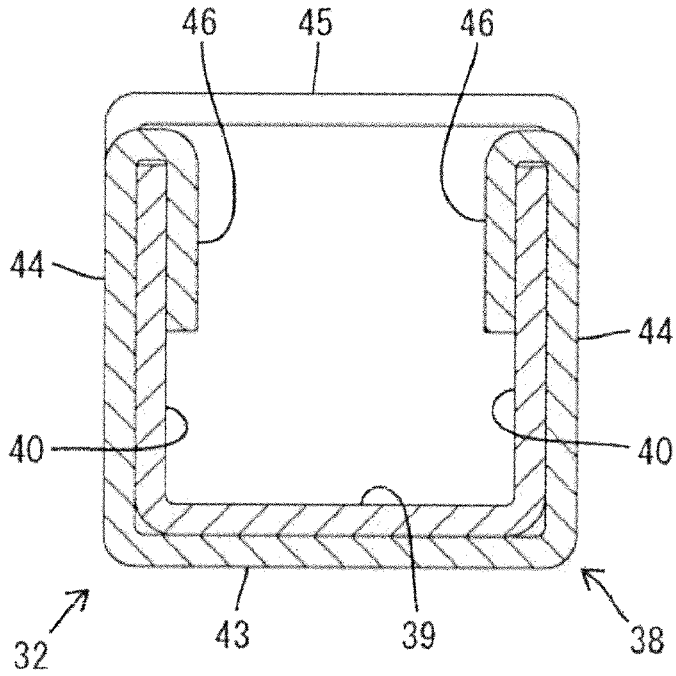
FIG. 10 is a section along D-D of FIG. 7.

The terminal main body 31 is formed by applying bending, folding and/or embossing to a conductive (metal) plate material punched out or cut into a specified shape. As shown in FIGS. 6, 8 and 9, a contact functioning portion 37 is at a front area of the terminal main body 31 and the wire crimping portion 35 is at a rear end area of the terminal main body 31. The contact functioning portion 37 includes a substantially box-shaped fitting portion 38 and two resilient contact pieces 34. As shown in FIGS. 8 to 10, the fitting portion 38 includes a lower wall 39 and two side walls 40 standing up at substantially right angles from left and right edges of the lower wall 39. As shown in FIGS. 6, 8 and 9, two substantially bilaterally symmetric plates 41 extend forward from the side walls 40 and hence in directions substantially opposite to the inserting direction ID of the tab 47 into the tube 33. The plates 41 and the side walls 40 are substantially flush and continuous with each other.

As shown in FIGS. 6, 8 and 9, each plate 41 is formed with the resilient contact piece 34 by cutting a part thereof and turning the cut part forward in substantially the same direction as an extending direction of the plate 41 from the fitting portion 38. The rear end of the resilient contact piece 34 is connected to a front part of the plate 41 and the front end thereof is located more forward than the front end of the plate 41. The resilient contact pieces 34 formed at the plates 41 are substantially are bilaterally symmetric. The shapes of the resilient contact pieces 34 viewed from above are curved to approach the mating resilient contact pieces 34. A part where a facing distance (lateral distance) between the both resilient contact pieces 34 is shortest defines contact portions 42 with the tab 47. The contact portions 42 are more forward than the front ends of the plates 41.

Figure 7:
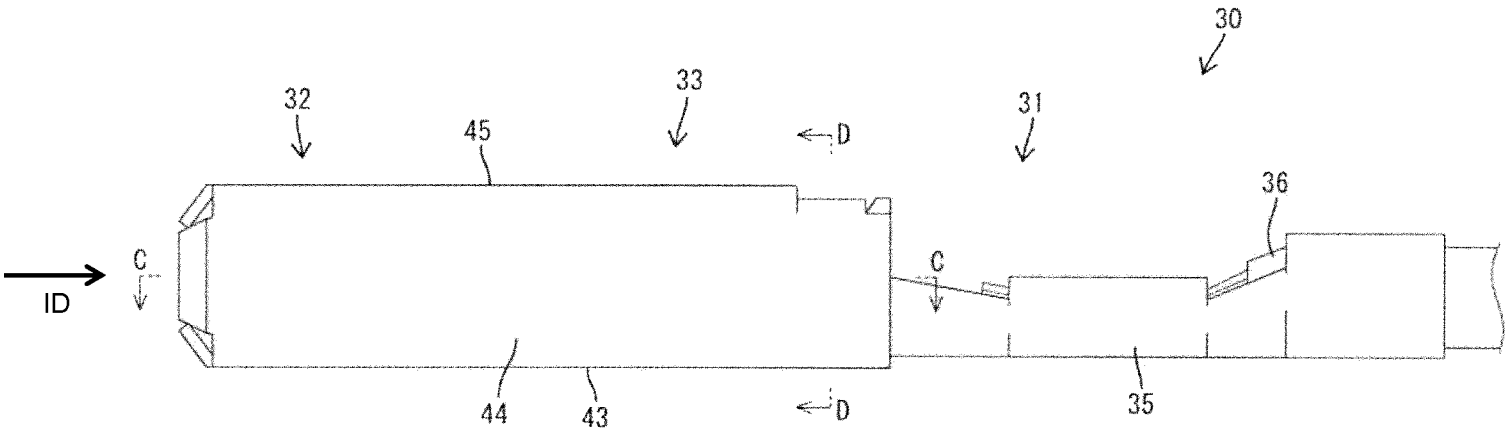
FIG. 7 is a side view of the terminal fitting.

As shown in FIGS. 7 and 10, the shell 32 includes a lower plate 43, two side plates 44 standing up at substantially right angles from left and right sides of the lower plate 43 and an upper plate 45 extending at a substantially right angle from the upper end of one side plate 44. The shell 32 is assembled with the terminal main body 31 to at least partly surround the contact functioning portion 37. In a state where the shell 32 is assembled, the fitting portion 38 is arranged at a rear end part of the shell 32 and the rectangular tube portion 33 is formed by the shell 32, the fitting portion 38 and the plates 41. As shown in FIG. 10, the lower plate 43 and the lower wall 39 at least partly overlap and are in substantially surface contact with each other. As shown in FIGS. 8 and 9, the left and right side plates 44 and the left and right side walls 40 also overlap in substantially surface contact with each other and the left and right side plates 44 and the left and right plates 41 also overlap in substantially surface contact with each other. Further, as shown in FIG. 10, holding pieces 46 are folded to extend in and down inside the fitting portion 38 from the upper ends of the side plates 44. Thus, the holding pieces 46 are held in close contact with the inner surfaces of the left and right side walls 40 and at least partly laterally sandwich the side walls 40 between the holding pieces 46 and the side plates 44 to hold the shell 32 and the terminal main body 31 in an assembled state. In the assembled state of the shell 32 and the terminal main body 31, the front extending ends of the resilient contact pieces 34 face the inner surfaces of the left and right side plates 44 while being spaced apart as shown in FIGS. 8 and 9.

In the process of inserting the tab 47 into the rectangular tube 33, the tab 47 resiliently deforms the contact pieces 34 and moves between the left and right resilient contact pieces 34. As a result, resilient contact pieces 34 are deformed resiliently out to move laterally away from each other. As shown in FIG. 9, resilient deformation amounts and resilient restoring forces of the resilient contact pieces 34 are maximized when the inserting operation of the tab 47 is completed.

The terminal fitting 30 of the second embodiment has the terminal main body 31 and the shell 32. The terminal main body 31 is formed with the fitting portion 38 and the resilient contact pieces 34. The shell 32 is a component separate from the terminal main body 31 and is a substantially rectangular tube that is assembled with the terminal main body 31 by engaging the fitting portion 38. An electrically conductive material, such as copper alloy, needs to be used for the terminal main body 31 formed with the resilient contact pieces 34 despite the relatively high cost. The shell 32 is separate from the terminal main body 31 need not have good electrical conductivity. Thus, an inexpensive material can be used for the shell 32. Therefore, the cost of the terminal fitting 30 of this second embodiment can be reduced as compared with the case where a terminal fitting is made entirely of an expensive electrically conductive material.

The plates 41 are cantilevered forward from the fitting portion 38 of the terminal main body 31 along a length direction of the shell 32. The resilient contact pieces 34 are formed by cutting parts of the plates 41 and turning the cut parts substantially in the extending direction of the plates 41. According to this configuration, the lengths of the resilient contact pieces 34 in the length direction of the shell 32 become shorter. Thus, resilient forces of the resilient contact pieces 34 increase to increase a contact pressure.

The invention is not limited to the above described embodiments. For example, the following embodiments also are included in the scope of the invention.

The terminal main body has the wire crimping portion in the form of an open barrel for connecting the terminal main body and the wire in the first and second embodiments. However, the terminal main body and a wire can be connected using another connection means, such as an insulation displacement blade, a soldering member or the like.

The terminal main body is connected to the wire in the first and second embodiments. However, the invention can be applied also in the case of connecting a terminal main body to a circuit board.

Two resilient contact pieces are provided in the first and second embodiments, but only one resilient contact piece may be provided.

The terminal main body is made of copper alloy and the shell is made of stainless steel or an inexpensive material other than stainless steel in the first and second embodiments. However, a combination of the materials of the terminal main body and the shell is not limited to those disclosed above and various combinations are possible.

The fitting portion is arranged at the rear of the shell and the resilient contact pieces extend forward from the fitting portion in the first embodiment. However, the fitting portion may be at the front end part of the shell and the resilient contact pieces may extend back from the fitting portion.

The restricting portions function as a means for preventing buckling of the resilient contact pieces in the above first embodiment. However, these restricting portions may function as a means for improving an effect of preventing the inclination of the resilient contact pieces by increasing the resilient forces of the resilient pieces.

The fitting portion is arranged at the rear of the shell, the plates extend forward from the fitting portion and the resilient contact pieces are turned forward from the plates in the second embodiment. However, the fitting portion may be arranged at the front end part of the shell, the plates may extend back from the fitting portion and the resilient contact pieces may be turned back from the plates.

In the second embodiment, the configuration of the first embodiment that two resilient pieces extend from the substantially opposite side edges of the resilient contact pieces may also be applied.

What is claimed is:

1. A terminal fitting having opposite front and rear ends spaced apart along a length direction, the terminal fitting comprising:

a terminal main body formed with a fitting portion, at least one plate cantilevered forward from the fitting portion and extending along the length direction of the terminal fitting and at least one resilient contact piece formed by cutting a part of the plate and turning the cut part along an extending direction of the plate; and a shell which is a component separate from the terminal main body and substantially in the form of a tube assembled with the terminal main body by engaging the fitting portion and surrounding the resilient contact piece.

2. The terminal fitting of claim 1, wherein the fitting portion is at only one end part of the shell in the length direction of the terminal fitting.

3. The terminal fitting of claim 1, wherein the resilient contact piece is cantilevered from the plate along the length direction of the terminal fitting.

4. A terminal fitting, comprising:

a terminal main body formed from a first material that is electrically conductive, the terminal main body having opposite front and rear ends, a fitting portion, two opposed resilient contact pieces cantilevered forward from the fitting portion, two resilient pieces cantilevered rearward from opposite sides of each of the resilient contact pieces and bent outward; and a shell formed from a second material that is different than the first material, the shell being substantially in the form of a tube assembled with the terminal main body by engaging the fitting portion and surrounding the resilient contact pieces, the shell having side walls outward of and engaging the resilient pieces, restricting pieces cut from the side walls of the shell to cantilever forward and in at positions rearward of the respective resilient pieces of the resilient contact pieces and facing the resilient pieces in a front to rear direction, whereby the restricting pieces are engageable with the respective resilient pieces to limit rearward deformation of the resilient contact pieces if a tab is inserted improperly into the terminal fitting.

5. The terminal fitting of claim 4, wherein the resilient pieces are vertically symmetric and bilaterally symmetric.

6. The terminal fitting of claim 4, wherein a front end part of the resilient contact piece forms a widened part having a larger height than more rearward parts of the resilient contact piece, wherein the widened part defines two projecting portions vertically projecting from both upper and lower edges of the resilient contact piece, the resilient pieces being cantilevered rearward from the projecting portions.

7. A terminal fitting comprising:

a terminal main body formed from a first material that is electrically conductive, the terminal main body having opposite front and rear ends spaced apart along a length direction, a fitting portion and two opposed plates cantilevered forward from the fitting portion and extending along the length direction, resilient contact pieces formed by cutting parts of the plates and turning the cut parts along an extending direction of the respective plates; and a shell formed from a second material that is different than the first material, the shell being substantially in the form of a tube assembled with the terminal main body by engaging the fitting portion and surrounding the resilient contact pieces.

* * * * *